US011040232B1

(12) United States Patent
Olivier

(10) Patent No.: US 11,040,232 B1
(45) Date of Patent: Jun. 22, 2021

(54) HYDRODYNAMIC EXERCISE DEVICE AND METHOD

(71) Applicant: Consumer Wellness, LLC, Sherman Oaks, CA (US)

(72) Inventor: Albert L. Olivier, Morristown, NJ (US)

(73) Assignee: Consumer Wellness, LLC, Sherman Oaks (CA)

( * ) Notice: Subject to any disclaimer, the term of this patent is extended or adjusted under 35 U.S.C. 154(b) by 0 days.

(21) Appl. No.: 16/922,154

(22) Filed: Jul. 7, 2020

(51) Int. Cl.
*A63B 21/06* (2006.01)
*A63B 21/008* (2006.01)

(52) U.S. Cl.
CPC ..... *A63B 21/0602* (2013.01); *A63B 21/008* (2013.01)

(58) Field of Classification Search
CPC ..... A63B 21/0602; A63B 21/008
See application file for complete search history.

(56) References Cited

U.S. PATENT DOCUMENTS 1,005,791 A * 10/1911 Angell ..... A63B 21/072 482/93
1,801,701 A * 4/1931 Turrall ..... A63D 5/04 273/387
3,085,357 A * 4/1963 Nissen ..... A63B 21/4009 482/43
3,480,280 A * 11/1969 Gamertsfelder ..... A63B 67/06 473/594
3,756,592 A * 9/1973 Johnson ..... A61H 23/06 482/110
3,997,159 A * 12/1976 Malhas ..... A63B 69/385 473/464
4,090,706 A * 5/1978 Reda ..... A63B 21/0004 482/122
4,223,474 A * 9/1980 Strauss ..... A63H 33/00 446/221
4,239,211 A * 12/1980 Wilkerson ..... A63B 21/065 156/301
4,303,239 A * 12/1981 Walsh, Jr. ..... A63B 21/0603 482/105

(Continued)

*Primary Examiner* — Garrett K Atkinson
(74) *Attorney, Agent, or Firm* — Richard M. Goldberg

(57) ABSTRACT

Exercise devices and methods avoid the establishment and transmission of any abrupt impact to a person during the conduct of an exercise routine with an exercise device having an elongate tubular body of flexible material with an internal chamber extending longitudinally between opposite terminal ends of the chamber, and a liquid medium partially filling the chamber so as to be movable between the terminal ends in response to manipulation of the tubular body. The chamber is provided with a reentrant curved contour configuration at each terminal end such that during manipulation of the tubular body while conducting the exercise routine, the liquid medium, upon reaching a terminal end of the chamber, will follow a smooth, uninterrupted return path along the reentrant curved contour configuration, thereby creating an exercise force while avoiding the establishment and transmission of any abrupt impact at a corresponding terminal end. A transparent portion of the tubular body reveals instructive or entertaining images displayed within the tubular body during the conduct of an exercise routine.

14 Claims, 4 Drawing Sheets

(56) References Cited

U.S. PATENT DOCUMENTS 4,396,190 A * 8/1983 Wilkerson ..... A63B 21/065 273/DIG. 30
4,527,796 A * 7/1985 Critelli ..... A63B 21/0602 473/442
4,540,173 A * 9/1985 Hopkins, Jr. ..... A63B 21/0552 482/124
4,659,078 A * 4/1987 Blome ..... A63B 21/0602 482/110
5,076,575 A * 12/1991 Eylander ..... A63B 21/065 482/105
5,105,804 A * 4/1992 Van Nostrand ..... A61H 37/005 4/573.1
5,258,018 A * 11/1993 Van Nostrand ..... A61H 37/005 4/573.1
5,393,285 A * 2/1995 Fischer, Sr. ..... A63B 21/0602 482/106
5,848,946 A * 12/1998 Stillinger ..... A63B 21/00189 473/594
5,857,946 A * 1/1999 Brown ..... A63B 21/072 482/108
5,891,000 A * 4/1999 Phillips ..... A63B 21/00189 482/49
D615,137 S * 5/2010 Ivanov ..... D21/680
7,828,703 B1 * 11/2010 Boesch ..... A63B 23/12 482/112
D631,924 S * 2/2011 Baldwin ..... D21/662
7,942,785 B1 * 5/2011 Russell ..... A63B 21/072 482/44
8,033,966 B2 * 10/2011 Ayoub ..... A63B 23/12 482/121
D656,567 S * 3/2012 Ivanov ..... D21/680
8,262,546 B1 * 9/2012 Lashinske ..... A63B 21/0602 482/110
8,388,475 B2 * 3/2013 Leefeldt ..... A63B 43/04 473/594
8,888,665 B2 * 11/2014 Pfitzer ..... A63B 21/0724 482/104
9,039,574 B2 * 5/2015 Wilson ..... A63B 21/0004 482/46
2006/0199710 A1 9/2006 Weber
2007/0087912 A1 * 4/2007 DeCologero ..... A63B 69/201 482/86
2011/0165978 A1 * 7/2011 Leefeldt ..... A63B 43/04 473/594
2017/0021221 A1 * 1/2017 Hannula ..... A63B 21/065
2017/0036087 A1 * 2/2017 Codrington ..... B32B 1/02
2020/0215375 A1 * 7/2020 Fujii ..... A63B 21/0724
2020/0282279 A1 * 9/2020 Braun ..... A63F 7/0005

* cited by examiner

HYDRODYNAMIC EXERCISE DEVICE AND METHOD

The present invention relates generally to devices and methods for carrying out dynamic exercise routines and pertains, more specifically, to facilitating such exercise routines while avoiding the generation and transmission of deleterious abrupt impacts to a person during the conduct of a dynamic exercise routine.

Exercise devices that employ hydrodynamics to attain effective exercise forces during relatively simple exercise routines have been available over the past several years. These exercise devices usually employ a liquid medium, such as water, captured within a flexible tubular body provided with handles so that manipulation of the tubular body during an exercise routine results in movement of the liquid medium to create exercise forces effective when carrying out the desired exercise routine.

The present invention provides improvements in exercise devices that employ hydrodynamics. As such, the present invention attains several objects and advantages, some of which are summarized as follows: Utilizes the principles of hydrodynamics in an exercise device and method while avoiding deleterious abrupt impacts transmitted to a person conducting an exercise routine; enables a person to carry out beneficial structured exercises without encountering deleterious abrupt impacts; facilitates the establishment and performance of beneficial exercise routines through viewable visual displays; provides an easily transported, highly mobile exercise device for convenient use at any one of a variety of locations; enables simple, compact storage of a hydrodynamic exercise device when not in use, and ease of preparation for use; creates and provides maximum benefits for increased muscular strength and endurance, flexibility and stability; provides a simple construction of inexpensive, durable materials for economical construction and long-term exemplary performance.

The above objects and advantages, as well as further objects and advantages, are attained by the present invention which may be described briefly as an exercise device for manipulation to create exercise forces during the conduct of dynamic exercise routines, the exercise device comprising: an elongate tubular body of flexible material having an internal chamber extending longitudinally between opposite terminal ends of the chamber; a liquid medium partially filling the chamber so as to be movable between the terminal ends in response to manipulation of the tubular body; a pair of grips integrated with the tubular body, each grip located in juxtaposition with a corresponding terminal end of the chamber; and the chamber having a reentrant curved contour configuration at each terminal end such that during manipulation of the tubular body, gripped at the grips while conducting an exercise routine, the liquid medium, upon reaching a terminal end of the chamber, will follow a smooth, uninterrupted return path along the reentrant curved contour configuration, thereby creating an exercise force while avoiding the establishment and transmission of any abrupt impact to a corresponding grip.

In addition, the present invention provides a method for avoiding the establishment and transmission of any abrupt impact to a person conducting an exercise routine with an exercise device having an elongate tubular body of flexible material with an internal chamber extending longitudinally between opposite terminal ends of the chamber, and a liquid medium partially filling the chamber so as to be movable between the terminal ends in response to manipulation of the tubular body, the method comprising: providing the chamber with a reentrant curved contour configuration at each terminal end such that during manipulation of the tubular body while conducting the exercise routine, the liquid medium, upon reaching a terminal end of the chamber, will follow a smooth, uninterrupted return path along the reentrant curved contour configuration, thereby creating an exercise force while avoiding the establishment and transmission of any abrupt impact at a corresponding terminal end.

Further, the present invention provides an exercise device for manipulation to create exercise forces during the conduct of dynamic exercise routines, the exercise device comprising: an elongate tubular body of flexible material having a wall enclosing an internal chamber extending longitudinally between opposite terminal ends of the chamber for containing a volume of liquid medium that will partially fill the chamber so as to be movable between the terminal ends of the chamber in response to manipulation of the tubular body; and a pair of grips integrated with the tubular body, each grip located in juxtaposition with a corresponding terminal end of the chamber; the wall of the elongate tubular body including an essentially transparent first wall portion, a second wall portion placed laterally opposite the first wall portion, and visual material placed upon the second wall portion so as to be visible through the first wall portion.

Still further, the present invention accomplishes, in a method in which dynamic exercise routines are conducted utilizing an elongate tubular body of flexible material having a wall enclosing an internal chamber extending longitudinally between opposite terminal ends of the chamber and containing a volume of liquid medium partially filling the chamber so as to be movable between the terminal ends of the chamber in response to manipulation of the tubular body, providing the wall of the elongate tubular body with an essentially transparent first wall portion, a second wall portion placed laterally opposite the first wall portion, and visual material placed upon the second wall portion so as to be visible through the first wall portion during the exercise routines.

The invention will be understood more fully, while still further objects and advantages will become apparent, in the following detailed description of preferred embodiments of the invention illustrated in the accompanying drawing, in which.

Figure 1:
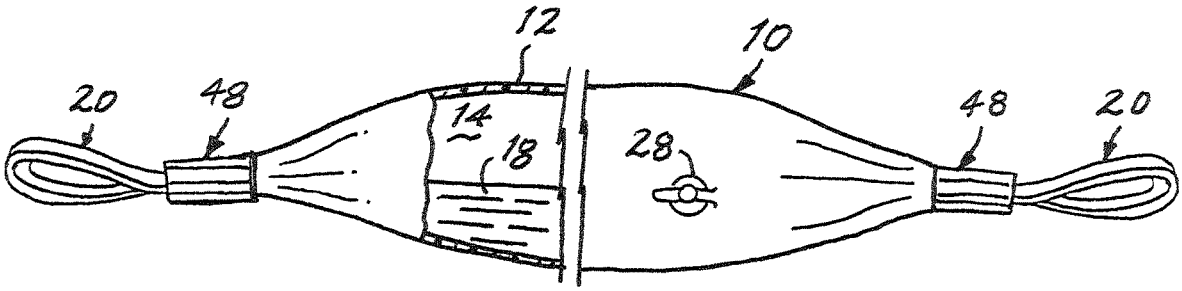
FIG. 1 is a side elevational view of an exercise device constructed in accordance with the present invention, partially cut-away to reveal interior details of construction.
Figure 2:
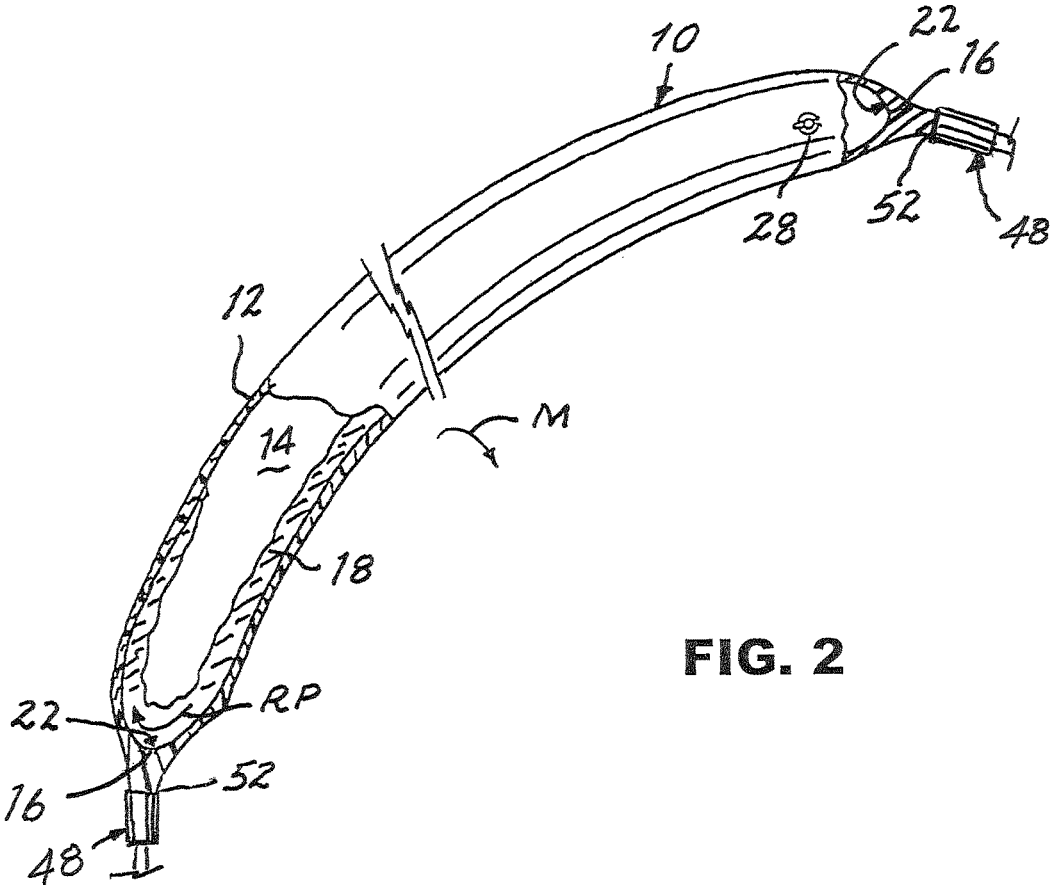
FIG. 2 is a pictorial view, partially broken away, of the exercise device in use during an exercise routine.

Referring now to the drawing, and especially to FIGS. 1 and 2 thereof, an exercise device constructed in accordance with the present invention is shown at 10 and is seen to include an elongate tubular body 12 having a wall 13 of flexible material enclosing an internal chamber 14 extending longitudinally between opposite terminal ends 16 of the chamber 14. A liquid medium, shown in the form of water 18, partially fills the chamber 14 so as to be movable between the terminal ends 16 in response to manipulation of the tubular body 12 during the conduct of a hydrodynamic exercise routine, exercise device 10 being shown in FIG. 2 during the conduct of one such exercise routine.

A pair of grips is shown in the form of straps 20 integrated with the tubular body 12, with each strap 20 located in juxtaposition with a corresponding terminal end 16 of the chamber 14. During various exercise routines, straps 20 are grasped and tubular body 12 is manipulated through a series of maneuvers, one such maneuver being characterized by arrow M in FIG. 2, during which tubular body 12 takes up orientations and configurations enabled by virtue of the flexible nature of wall 13 of tubular body 12, in response to movements performed by the person conducting an exercise routine. As tubular body 12 is driven into various orientations and configurations, the water 18 contained within tubular body 12 will migrate within the chamber 14, from one terminal end 16 to the other, and thereby generate forces that are transmitted to the person participating in a particular exercise routine so as to provide appropriate resistance forces to various muscle groups being addressed during a workout.

In order to avoid the establishment and transmission of any abrupt impact to a corresponding strap 20 and, consequently, to the person conducting an exercise routine, chamber 14 is provided with a reentrant curved contour configuration 22 at each terminal end 16 (see also FIG. 3) such that water 18, upon reaching a terminal end 16 of the chamber 14, will follow a smooth, uninterrupted return path, illustrated in FIG. 2 by arrow RP, along the reentrant curved contour configuration 22, thereby creating a desired exercise force while avoiding the establishment and transmission to a corresponding strap 20 and, consequently, through the strap 20 to the person conducting the exercise routine, of any abrupt impact which can have an adverse effect on that person. In the preferred construction, reentrant curved contour configuration 22 follows a generally parabolic profile 24.

Turning now to FIGS. 3 through 8, as well as to FIGS. 1 and 2, tubular body 12 preferably is constructed of one or a combination of more than one relatively thin, flexible synthetic polymeric materials such as a polyurethane film, or a polyurethane film coated onto a polyester fabric. Antimicrobial additives may be used to prevent bacteria growth within chamber 14. A fill valve 28 may be fabricated of urethane and is readily available for selectively introducing water 18 into chamber 14 in preparation for use of the exercise device 10, and for draining water 18 from chamber 14 to enable selective collapse and folding of tubular body 12 for convenient transportation or compact storage.

Figure 3:
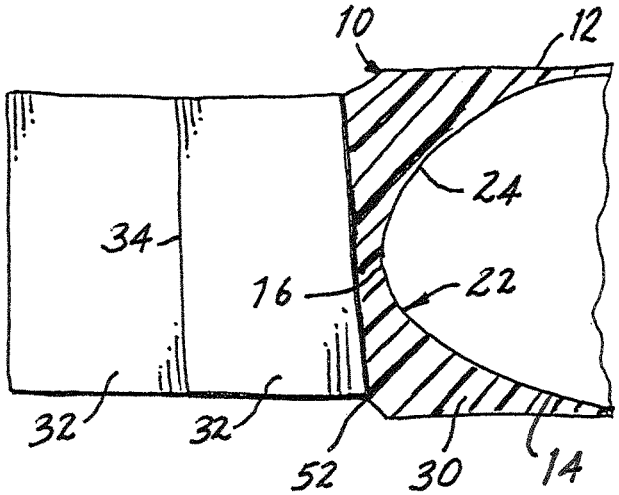
FIG. 3 is an enlarged, fragmentary cross-sectional view illustrating a step in the procedure for constructing the exercise device.
Figure 4:
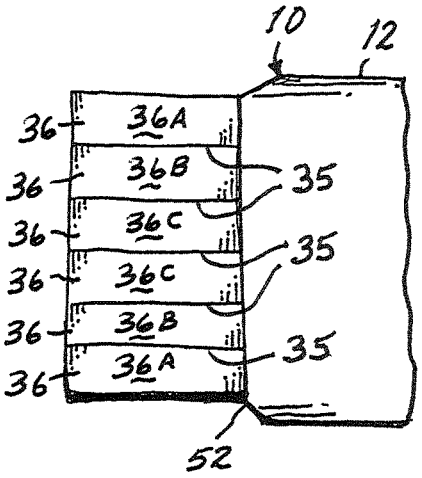
FIG. 4 is an enlarged, fragmentary view similar to FIG. 3, and showing a next subsequent step in the construction procedure.
Figure 5:
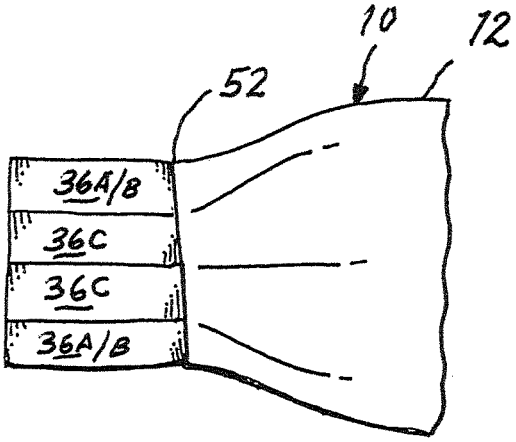
FIG. 5 is an enlarged fragmentary view similar to FIG. 4, and showing another subsequent step in the construction procedure.
Figure 6:
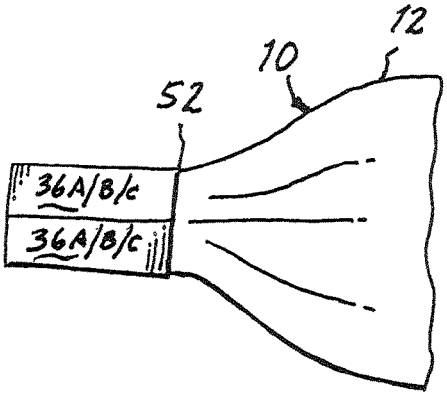
FIG. 6 is an enlarged fragmentary view similar to FIG. 5, and showing still another subsequent step in the construction procedure.
Figure 7:
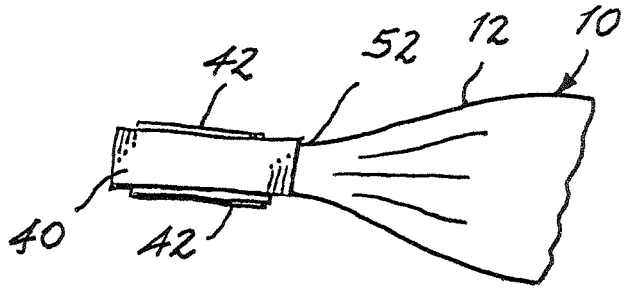
FIG. 7 is an enlarged fragmentary view similar to FIG. 6, and showing a further subsequent step in the construction procedure.
Figure 8:
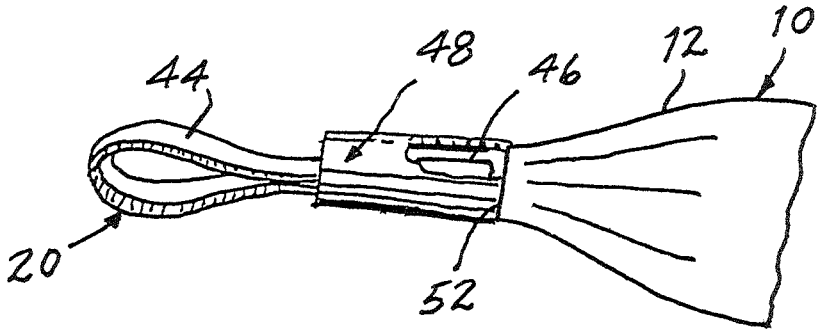
FIG. 8 is an enlarged fragmentary view similar to FIG. 7, and showing a still further subsequent step in the construction procedure.

In a sequence of operations illustrated in FIGS. 3 through 8, in connection with the construction of exercise device 10, tubular body 12 is sealed throughout area 30 adjacent each terminal end 16 of chamber 14, to establish the aforesaid reentrant curved contour configuration 22 at each terminal end 16 of chamber 14, and to provide contiguous pads 32, as seen in FIG. 3, which pads 32 then are folded upon one another along a transverse line 34, then sealed to one another, as by heat-sealing, and then provided with longitudinal fold lines 35 that divide the sealed-together pads 32 into a series of longitudinally extending parallel sections, here shown in FIG. 4 as six parallel sections 36. Then, each outermost section 36A is folded over a next-contiguous section 36B, as seen in FIG. 5 and, as seen in FIG. 6, the folded-over sections 36A, 36B are folded into juxtaposition with further contiguous sections 36C. The folded-over sections 36A, 36B and 36C then are folded over one-another to create an extended block 40, as seen in FIG. 7, which then is provided with sub-pads 42 of heat-sealable hook-and-loop material, preferably nylon. Then, as seen in FIG. 8, a strip 44, preferably of tubular nylon webbing, is looped and joined to each block 40, in a corresponding sub-assembly 46, and each sub-assembly 46 is heat-welded for a permanent connection. Each heat-welded sub-assembly 46 then is enclosed within a tubular cuff 48 of foam synthetic polymeric material, all as illustrated in FIG. 8. In this manner, strip 44 provides strap 20, which serves as a convenient and secure handle at each end 52 of tubular body 12, while each end 52 provides chamber 14 with the desired reentrant curved contour configuration 22 at each terminal end 16.

Exercise device 10 may be made available in a range of sizes. Thus, in preferred embodiments, tubular body 12 is provided with a length between ends 52 of about fifty to sixty inches and, when set out flat, an overall laid-flat diameter of about seven and one-half inches.

Figure 9:
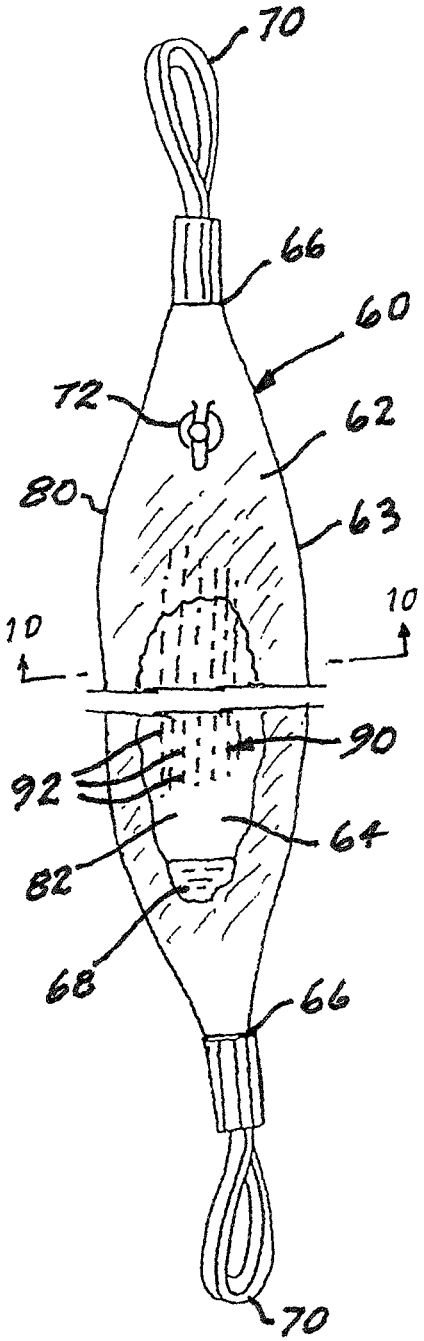
FIG. 9 is a front elevational view of another exercise device constructed in accordance with the present invention, partially cut-away to reveal interior details of construction.
Figure 10:
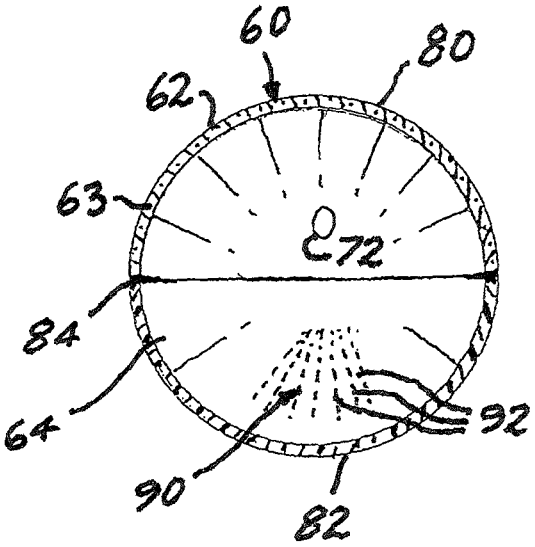
FIG. 10 is an enlarged cross-sectional view taken along line 10-10 of FIG. 9.

With reference now to FIGS. 9 and 10, another exercise device constructed in accordance with the present invention is shown at 60 and is seen to include an elongate tubular body 62 having a wall 63 of flexible material enclosing an internal chamber 64 extending longitudinally between opposite terminal ends 66 of the chamber 64. A liquid medium, shown in the form of water 68, partially fills the chamber 64 so as to be movable between the terminal ends 66 in response to manipulation of the tubular body 62 during the conduct of a hydrodynamic exercise routine. A pair of grips is shown in the form of straps 70 integrated with the tubular body 62, with each strap 70 located in juxtaposition with a corresponding terminal end 66 of the chamber 64, enabling the conduct of such exercise routines, and a fill valve 72 is readily available for selectively introducing water 68 into chamber 64 in preparation for use of the exercise device 60, and for draining water 68 from chamber 64 to enable selective collapse and folding of tubular body 62 for convenient transportation or compact storage, all as described above in connection with exercise device 10.

In the present embodiment, wall 63 includes a first wall portion 80 and a second wall portion 82 placed laterally opposite the first wall portion 80, the wall portions 80 and 82 shown as being joined together, as by a sealed joint 84, to establish the closed chamber 64. Wall portion 80 is constructed of an essentially transparent material, preferably a clear synthetic polymeric material such as a clear polyurethane, and visual material 90, shown in the form of characters or illustrations 92, is displayed at second wall portion 82 by being located on second wall portion 82, so as to be visible through the window provided by first wall portion 80. The visible material may include instructions or images to assist in carrying out selected exercise routines, or promotional information, or merely aesthetic designs to be enjoyed while carrying out an exercise routine. In addition, accuracy in the conduct of a particular exercise routine may be confirmed by observation of the movement of water 68 within chamber 64. Second wall portion 82 may be constructed of a substantially opaque synthetic polymeric material, such as a urethane cast-coated polyester fabric.

It will be seen that the present invention attains all of the objects and advantages summarized above, namely: Utilizes the principles of hydrodynamics in an exercise device and method while avoiding deleterious abrupt impacts transmitted to a person conducting an exercise routine; enables a person to carry out beneficial structured exercises without encountering deleterious abrupt impacts; facilitates the establishment and performance of beneficial exercise routines through viewable visual displays; provides an easily transported, highly mobile exercise device for convenient use at any one of a variety of locations; enables simple, compact storage of a hydrodynamic exercise device when not in use, and ease of preparation for use; creates and provides maximum benefits for increased muscular strength and endurance, flexibility and stability; provides a simple construction of inexpensive, durable materials for economical construction and long-term exemplary performance.

It is to be understood that the above description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An exercise device for manipulation to create exercise forces during the conduct of dynamic exercise routines, the exercise device comprising:

an elongate tubular body of flexible material having a wall enclosing an internal chamber extending longitudinally between opposite terminal ends of the chamber for containing a volume of liquid medium that will partially fill the chamber so as to be movable between the terminal ends of the chamber in response to manipulation of the tubular body; and a pair of grips integrated with the tubular body, each grip located in juxtaposition with a corresponding terminal end of the chamber;

the chamber having a reentrant curved contour configuration at each terminal end such that during manipulation of the tubular body, gripped at the grips while conducting an exercise routine, the liquid medium, upon reaching a terminal end of the chamber, will follow a smooth, uninterrupted return path along the reentrant curved contour configuration, thereby creating an exercise force while avoiding the establishment and transmission of any abrupt impact to a corresponding grip.

2. The exercise device of claim 1 wherein the reentrant curved contour configuration comprises a parabolic profile.

3. The exercise device of claim 1 including a plurality of sections extending along the tubular body in juxtaposition with each terminal end of the chamber and folded along fold lines to establish a block adjacent each terminal end, and a looped strip joined to each block, thereby providing a handle at each grip.

4. The exercise device of claim 3 wherein the sections extend longitudinally, parallel to one another along the tubular body.

5. The exercise device of claim 4 wherein the reentrant curved contour configuration comprises a parabolic profile.

6. The exercise device of claim 1 wherein the tubular body is constructed of at least one synthetic polymeric material.

7. The exercise device of claim 6 including a plurality of sections extending along the tubular body in juxtaposition with each terminal end of the chamber and folded along fold lines to establish a block adjacent each terminal end, and a looped strip joined to each block, thereby providing a handle at each grip.

8. The exercise device of claim 7 wherein the reentrant curved contour configuration comprises a parabolic profile.

9. The exercise device of claim 1 wherein the wall of the elongate tubular body includes an essentially transparent first wall portion, a second wall portion placed laterally opposite the first wall portion, and visual material placed upon the second wall portion so as to be visible through the first wall portion.

10. The exercise device of claim 9 wherein the first wall portion is constructed of a first synthetic polymeric material, and the second wall portion is constructed of a second synthetic polymeric material.

11. The exercise device of claim 10 wherein the first synthetic polymeric material is comprised of a clear polyurethane, and the second synthetic polymeric material is comprised of a urethane cast-coated polyester fabric.

12. An exercise device for manipulation to create exercise forces during the conduct of dynamic exercise routines, the exercise device comprising:

an elongate tubular body of flexible material having a wall enclosing an internal chamber extending longitudinally between opposite terminal ends of the chamber and constructed for containing a volume of liquid medium that will partially fill the chamber so as to be movable between the terminal ends of the chamber in response to manipulation of the tubular body; and a pair of grips integrated with the tubular body, each grip located in juxtaposition with a corresponding terminal end of the chamber;

the wall of the elongate tubular body including an essentially transparent first wall portion, a second wall portion placed laterally opposite the first wall portion, and visual material placed upon the second wall portion so as to be visible through the first wall portion.

13. The exercise device of claim 12 wherein the first wall portion is constructed of a first synthetic polymeric material, and the second wall portion is constructed of a second synthetic polymeric material.

14. The exercise device of claim 13 wherein the first synthetic polymeric material is comprised of a clear polyurethane, and the second synthetic polymeric material is comprised of a urethane cast-coated polyester fabric.

* * * * *